US006367671B1

(12) United States Patent
Hanse et al.

(10) Patent No.: US 6,367,671 B1
(45) Date of Patent: Apr. 9, 2002

(54) STOPPER ROD

(75) Inventors: Eric Hanse, Feignies; Pascal Dubois, Rue Parkeur, both of (FR)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/856,206

(22) PCT Filed: Nov. 16, 1999

(86) PCT No.: PCT/BE99/00146

§ 371 Date: May 18, 2001

§ 102(e) Date: May 18, 2001

(87) PCT Pub. No.: WO00/30786

PCT Pub. Date: Jun. 2, 2000

(30) Foreign Application Priority Data

Nov. 20, 1998 (BE) ..... 9800837
Nov. 20, 1998 (BE) ..... 9800838

(51) Int. Cl.[7] ..... B22D 41/08
(52) U.S. Cl. ..... 222/602; 222/597
(58) Field of Search ..... 222/597, 602, 222/603

(56) References Cited

U.S. PATENT DOCUMENTS

| | | | | |
|---|---|---|---|---|
| 4,791,978 A | | 12/1988 | Fishler | |
| 4,946,083 A | | 8/1990 | Fishler et al. | |
| 5,024,422 A | | 6/1991 | Fishler et al. | |
| 5,071,043 A | * | 12/1991 | Dumazeau et al. | 222/602 |

FOREIGN PATENT DOCUMENTS

| | | |
|---|---|---|
| BE | 9800838 | 8/2000 |

* cited by examiner

*Primary Examiner*—Scott Kastler
(74) *Attorney, Agent, or Firm*—James R. Williams

(57) ABSTRACT

The present invention concerns a one-piece stopper rod whose gas tightness is improved. In particular, the stopper rod of the present invention has a body of refractory material comprised at least partially of a refractory material relatively impermeable to gases.

10 Claims, 2 Drawing Sheets

STOPPER ROD

FIELD OF THE INVENTION

The present invention concerns a new stopper rod for regulating the flow of a molten metal from a casting group, for example, steel or cast iron, from a distributor or a casting ladle, and more particularly a one-piece stopper rod that has means for attachment to a lifting mechanism. In a particular embodiment, the stopper rod also has means for introducing an inert gas, such as argon, into the molten metal bath during continuous casting operations.

BACKGROUND OF THE INVENTION

Such a stopper rod and its use are well known to the skilled artisan, in particular by U.S. Pat. Nos. 4,946,083 and 5,024,422, which are hereby incorporated by reference. These documents describe a one-piece stopper rod that can be attached to a lifting mechanism, comprised of:

a) an elongated body of refractory material that has a borehole positioned coaxially with respect to the body of the stopper rod and adapted to fixedly receive a metal rod for its attachment to a lifting mechanism. The axial borehole of the body of refractory material has an enlarged part with an annular sealing surface spaced away from the upper end of the body of refractory material. The means for attachment of the metal rod are generally positioned between the enlarged part and the lower end of the body of refractory material. At its lower end, the body of refractory material may have means for introducing gas into the molten metal bath; and b) an elongated metal rod attached to the body of refractory material and having an axial borehole communicating in its lower part with the borehole of the body of refractory material. The rod has a collar carrying an annular sealing surface facing the annular sealing surface of the body of refractory material to create a gas tight seal. The upper end of the rod is adapted to be attached to a lifting mechanism that permits the vertical displacement of the stopper rod inside of a casting group such as a distributor. Means for fastening to the body of refractory material are generally positioned between the collar and the lower end of the metal rod.

The stopper rod may be connected to a gas supply line, generally but not obligatorily, through the upper end of the rod. The stopper rod may then permit the introduction of gas into the molten metal. When such a stopper rod is used, the gas is conveyed through the axial borehole of the body of refractory material to the stopper rod's lower part. The body of refractory material may have in its lower part a means for introducing gas into the molten metal bath. The annular sealing surfaces of the rod and the body of refractory material facing each other and prevent substantial losses of inert gas and the infiltration of air.

To improve this tightness even more, it was proposed to place an annular gas tight gasket between these sealing surfaces. U.S. Pat. No. 4,946,083, for example, indicates that when a gasket with a thickness of about 0.4 mm and of a material resistant to high temperatures, e.g., graphite, is in place, the interface between the annular sealing surfaces of the rod and the body of refractory material furnishes a tightness capable of resisting a pressure up to 3 bars.

This seal is essential for casting high-grade molten metal. In the first place, it is necessary to assure a good protection against the infiltration of air responsible for oxidizing the molten metal during pouring. On the other hand, when an inert gas is injected through the stopper rod, it is also indispensable to reduce the losses of inert gas that cause production cost overruns, which are far from negligible.

Present systems still do not, however, furnish a completely satisfactory solution for these two points of view.

SUMMARY OF THE INVENTION

In pursuing their research in this domain, the applicants discovered that these problems are due to the fact that, for different reasons (unscrewing of the rod, expansion of the rod, etc.), a loss of tightness could occur at the sealing joint between the annular sealing surfaces of the rod and the body of refractory material facing each other.

The applicants then discovered that the tightness of the stopper rod could be improved by using a body of refractory material of a particular type.

According to the present invention, a stopper has a one-piece body of refractory material, constituted at least partially of a refractory material that is relatively impermeable to gases.

DETAILED DESCRIPTION OF THE INVENTION

Figure 1:
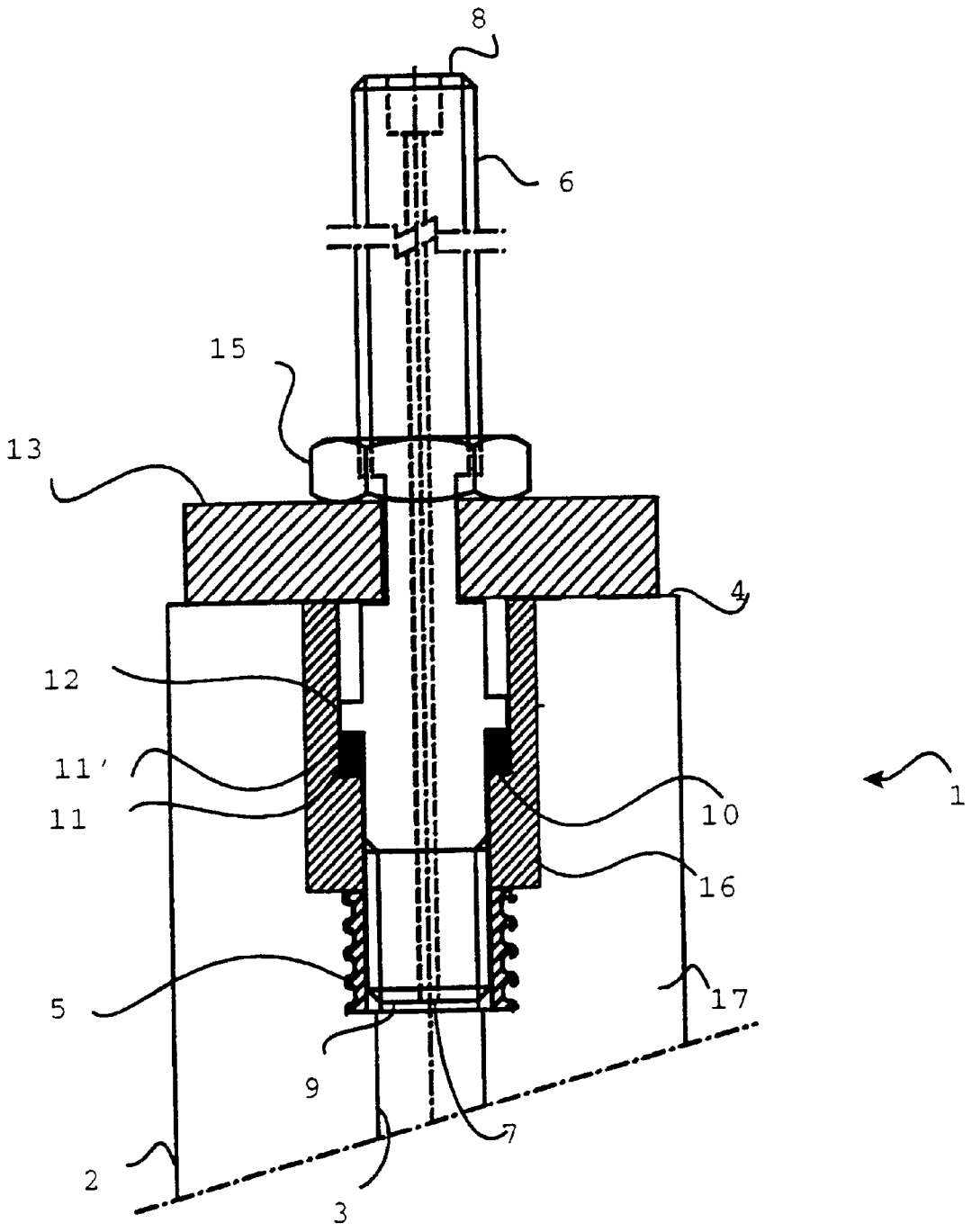
FIG. 1 shows a cross-section of an upper end of a stopper rod of the present invention.

The present invention concerns a one-piece stopper rod that can be attached to a lifting mechanism, comprised of:

a) an elongated body of refractory material, that has
   i. a borehole positioned coaxially with respect to the body of the stopper rod and adapted to receive in a fixed manner a metal rod for its attachment to a lifting mechanism, the axial borehole of the body of refractory material having an enlarged part that presents an annular sealing surface spaced away from the upper end of the body of refractory material;
   ii. means for attaching the metal rod; and b) an elongated metal rod attached to the body of refractory material adapted at its upper end to be attached to a lifting mechanism for vertically displacing the stopper rod inside of a casting group; that is characterized in that the body of refractory material is comprised at least partially of an impermeable refractory material.

According to a particular embodiment of the invention, the stopper rod can be connected to a gas supply line. Therefore, at its lower end of the elongated body is a means for introducing gas into the molten metal bath, and the metal rod has an axial borehole communicating in its lower part with the borehole of the body of refractory material.

An impermeable material means a refractory material that is relatively impermeable to gas compared to conventional refractory materials that are used in the application. The impermeable material will have a specific permeability (expressed in $m^2$) at about the working temperature of the stopper rod that is less than that of conventional materials conventionally. Preferably, the specific permeability is less than half that of conventional materials. Conventional materials generally have a specific permeability between $5.10^{-17}$ and $5.10^{-16}m^2$. Impermeable materials that are preferred according to the present invention have a specific permeability less than $5.10^{-17}m^2$.

Suitable impermeable materials include mixtures in which additives capable of reducing the mean diameter of the pores have been incorporated. These additives are well-known to the skilled in the art. For example, fluxing agents such as the alkalis ($Na_2O$, $K_2O$, CaO, $B_2O_3$, . . . ), silicas etc. can be incorporated into the composition of the refractory material. Metallic elements that form carbides when brought to high temperature can also be incorporated. It is also possible to define the mean diameter of the pores by implementing a powdered composition whose granulometry is chosen to reduce the mean pore diameter. Obviously, one or more of these methods can be combined. Preferably fluxing agents are incorporated in the composition of the refractory material.

The applicants have found that it was not easy to obtain a refractory material presenting a good compromise between the properties of impermeability and resistance to corrosion by molten steel. Thus, according to a particular embodiment of the invention, the body of refractory material is comprised of at least two different refractory materials; the body of refractory material having a first part comprised of an impermeable material that substantially surrounds the region in which the sealing gasket is located and a second part comprised of refractory material resistant to corrosion by the molten metals. According to this embodiment, the part of the body of refractory material in contact with the molten metal is preferably comprised essentially of a refractory material resistant to corrosion, while the part comprised of an impermeable material substantially surrounds the region in which the sealing joint is located and is not in contact with the molten metal.

In this case, impermeable material is understood to be a material whose specific permeability in the vicinity of the working temperature of the stopper rod is less than that of the material or materials resistant to corrosion. Preferably, the specific permeability in the vicinity of the working temperature of the stopper rod of impermeable material is less than half that of the corrosion-resistant material. Conventional corrosion-resistant materials generally have a specific permeability between $5.10^{-17}$ and $5.10^{-16}m^2$. The impermeable materials preferred according to the present invention have a specific permeability less than $5.10^{-17}m^2$.

The body of refractory material according to the present invention can be prepared by any of the conventional techniques well known to the skilled artisan; in particular, this body of refractory material can be prepared by cold or hot pressing or even by isostatic pressing. For reasons of facilitation, in the case where the body of refractory material is comprised of several different refractory materials, it is preferable to press at least one of the parts previously, generally the part that is less accessible. As a general rule, it is thus preferable to press that part of the body of refractory material enveloping the region in which the sealing gasket is located beforehand.

The stopper rod involved in the present patent application is essentially similar to that described in the U.S. Pat. Nos. 4,946,083 and 5,024,422. As a variant, it is also possible to use a stopper rod that also has means for maintaining the compression of the sealing gasket in contact with the annular sealing surface of the body of refractory material as described in WO 00/30785, which is hereby incorporated by reference.

Figure 2:
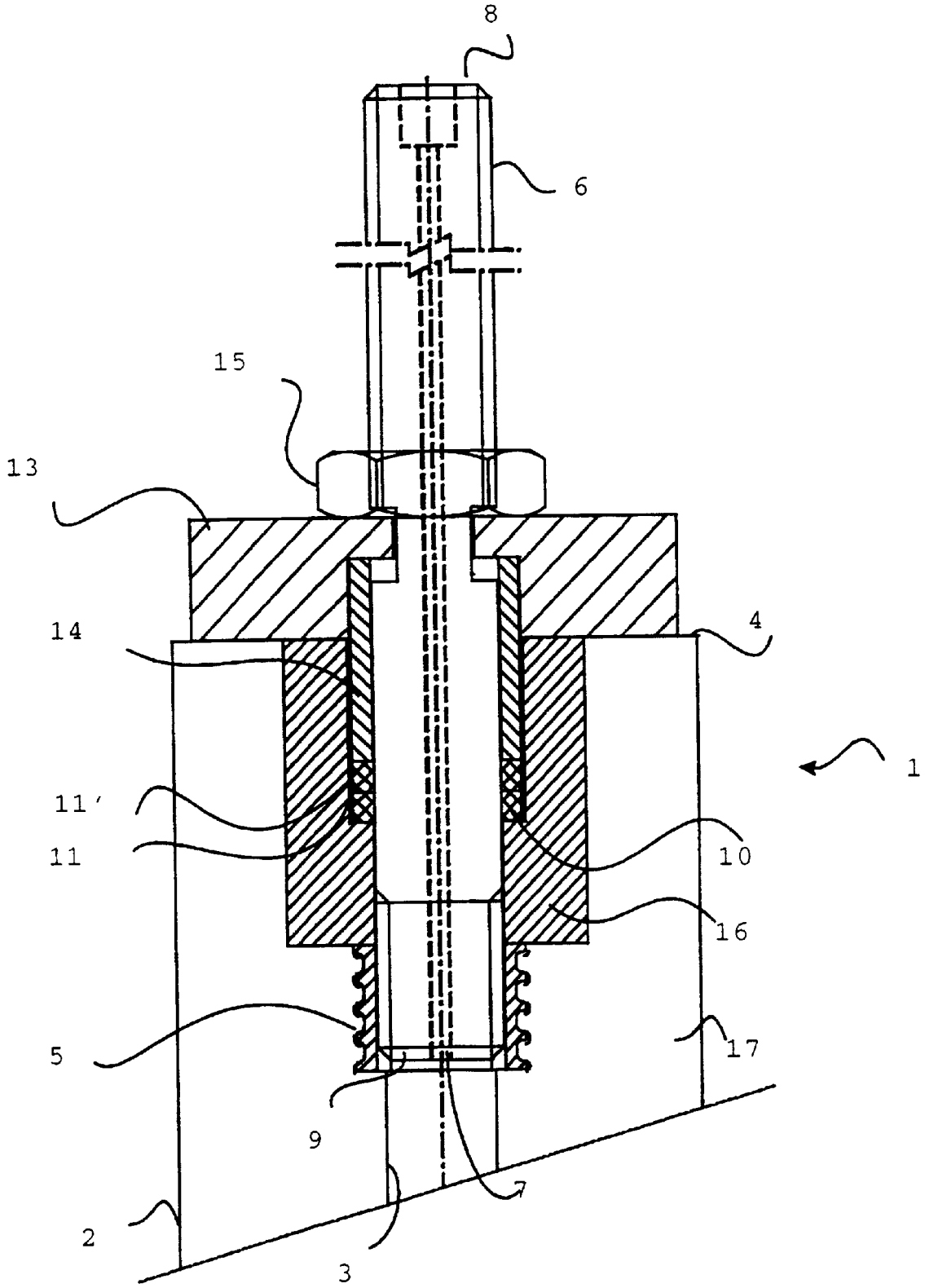
FIG. 2 shows a cross-section of an upper end of a stopper rod of the present invention.

FIGS. 1 and 2 are fragmentary views in cross section of the upper end of a stopper rod according to these modes of implementing the invention.

On these Figures, the stopper rod 1 is comprised of an elongated body of refractory material 2 with an axial borehole 4 extending from its upper end 4 to its lower end (not shown). The body of refractory material is provided with means for introducing inert gas (not shown) into the metal bath.

The body of refractory material also has means 5 for attaching a metal rod 6. The metal rod 6 also has an axial borehole 7 that passes through it from its upper end 8 to its lower end 9. The upper end 8 is adapted to receive a connector (not shown) for supplying an inert gas. Furthermore, the upper end 8 of the rod is adapted to be attached to a lifting mechanism (not shown). A gas under pressure, such as argon, is introduced into the axial borehole 3 of the body of refractory material by means of the rod 6 and is conveyed to the metal bath through the lower end of the body of refractory material.

The body of refractory material 2 has an enlarged part 10 that forms a sealing surface. Two graphite gaskets (11 and 11') rest on this sealing surface and thus prevent the infiltration of air or losses of inert gas.

The body of refractory material 2 is comprised of two different refractory materials; the body of refractory material is comprised of a first part 16 composed of a mixture relatively impermeable to the gases substantially surrounding the region in which the sealing gaskets 11 (and 11') are located, and a second part 17 comprising a refractory material resistant to corrosion by the molten metals.

In FIG. 1, the metal rod 6 has a collar 12 with annular sealing surface facing the annular sealing surface 10 of the borehole of the body of refractory material so as to create a seal against gases.

In FIG. 2, the sleeve 14 is fitted on the rod 6 and maintains the gaskets 11 and 11' under compression. The upper part of the sleeve is blocked by a washer 13, it in turn being retained by a nut 15.

The washer 13 is preferably in contact with the upper end 4 of the body of refractory material 2 to give the assembly an increased rigidity.

The sleeve 14 is comprised of a material having a coefficient of thermal expansion greater than that of the metal rod 6 and a length sufficient so that, under the effect of the temperature to which the stopper rod is brought during pouring, it expands sufficiently toward the lower end of the metal rod to at least compensate for the expansion of the metal rod.

Preferably, the expansion of the sleeve compensates essentially precisely for the expansion of the metal rod.

As can be seen in FIG. 2, the sleeve 14 can project at the upper end of the body of refractory material 2 if this is necessary to permit a sufficient length of the sleeve. The sleeve 14 is fitted on the metal rod 6 and forms with it a free assembly, turning, sliding or just sliding. The upper end of the sleeve 14 just butts on blocking means 13 and 15 located fixedly on the metal rod 6 so that, under the effect of expansion, the sleeve 14 lengthens axially only in the direction opposite the blocking means.

The material constituting the sleeve as well as its length are chosen as a function of the dimensions of the materials constituting the metal rod (generally machined from a steel bar with a coefficient of thermal expansion of the order of 12.5 $\mu m°\ C.^{-1}$) and the body of refractory material (typically comprised of a refractory material obtained by isostatic pressing with a coefficient of thermal expansion of 3–6 $\mu m°\ C.^{-1}$).

The material constituting the sleeve as well as its length are easily determined from the basic principles of thermal physics. Starting with the values thus determined in the first approximation and which generally furnish excellent results, it is then possible to optimize the system by trial and error without any difficulty.

According to the invention, the sleeve is comprised of a material with a high coefficient of thermal expansion capable of resisting the elevated temperatures to which the stopper rod is subjected during pouring. For example, refractory materials with a high coefficient of thermal expansion such as fritted magnesia can be used. The preferred materials for this application are found among metals or metal alloys with a high coefficient of thermal expansion and having a high melting point.

According to a particular embodiment of the invention, the stopper rod also has means for preventing the metal rod from separating from the body of refractory material. Such means are described in WO 00/30786. Thus, if a metal insert having a threaded axial internal borehole anchored in the body of refractory material is used as the means for attaching the rod to the body of refractory material, the rod will be prevented from becoming unscrewed from the insert by furnishing it with a pair of parallel plane surfaces at the point of emergence from the body of refractory material and by supporting on these plane surfaces an integral forked flange joined fixedly to the body of refractory material. This fixed joint can be accomplished by a pin inserted in a shaft through the forked flange and extending into the body of refractory material.

What is claimed is:

1. A stopper rod for use in the casting of molten metal comprising an elongated body including a lower end, an upper end, a longitudinal axis extending between the lower and upper ends, an inner surface open to the upper end and defining a borehole along the longitudinal axis, the borehole having an enlarged portion comprising an annular sealing surface spaced away from upper end, and a fastener within the borehole spaced further from the upper end than the annular sealing surface and adapted to secure the elongated body to a metal rod, the elongated body comprising least two different refractory materials including:

a) an impermeable material having a specific permeability lower than $5.10^{-17}m^2$, and substantially surrounding the annular sealing surface, whereby gas leakage through the annular sealing surface is substantially prevented; and b) a corrosion-resistant material contacting the molten metal.

2. The stopper rod of claim 1, wherein the stopper rod comprises a metal rod having a first end and a second end, the first end secured to the fastener in the body, the second end adapted to attach to a lifting mechanism for vertically displacing the stopper rod inside a casting group, the metal rod having an inner surface defining a throughflow bore between the first and second ends, the throughflow bore at the first end in fluid communication with the borehole of the body.

3. The stopper rod of claim 1, wherein the lower end of the body comprises a gas injector for introducing gas into the molten metal.

4. The stopper rod of claim 1, wherein the inpermeable material comprises at least one refractory additive capable of reducing mean pore-size.

5. The stopper rod of claim 4, wherein the refractory additive is selected from the group consisting of metallic elements that form carbides at elevated temperature and fluxing agents.

6. The stopper rod of claim 5, wherein the fluxing agent is selected from the group consisting of alkaline oxides or silicas.

7. The stopper rod of claim 1, wherein the impermeable material is formed from a powdered composition having a granulometry selected to produce low permeability.

8. The stopper rod of claim 2, wherein a collar on the metal rod cooperates with the annular sealing surface of the body to produce a gas-tight joint.

9. The stopper rod of claim 2, wherein the stopper rod comprises a sealing gasket contacting the annular sealing surface and a blocking device for compressing the sealing gasket against the annular sealing surface.

10. The stopper rod of claim 9, wherein the stopper rod comprises a sleeve fitted on the metal rod, and the blocking device compresses the sealing gasket through the sleeve.

* * * * *